US006286425B1

(12) United States Patent
Leib et al.

(10) Patent No.: US 6,286,425 B1
(45) Date of Patent: Sep. 11, 2001

(54) SHEET-FED ROTARY PRINTING MACHINE AND METHOD OF TRANSPORTING SHEETS INCLUDING A CYLINDER WITH A DISPLACEABLE OUTER PORTION

(75) Inventors: Rudolf Leib; Günter Stephan, both of Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/335,366

(22) Filed: Jun. 17, 1999

(30) Foreign Application Priority Data

Jun. 17, 1998 (DE) ..... 198 26 891

(51) Int. Cl.[7] ..... B41F 13/08
(52) U.S. Cl. ..... 101/137; 101/232
(58) Field of Search ..... 101/232, 409, 101/410, 408, 415.1, 247, 137; 118/249

(56) References Cited

U.S. PATENT DOCUMENTS

| | | | | |
|---|---|---|---|---|
| 3,592,136 | * | 7/1971 | Selman | 101/423 |
| 3,800,698 | * | 4/1974 | Kist et al. | 101/137 |
| 4,014,260 | * | 3/1977 | Schroter-Dommes et al. | 101/212 |
| 4,204,471 | * | 5/1980 | Becker | 101/410 |
| 4,217,824 | * | 8/1980 | Rebel et al. | 101/375 |
| 5,081,927 | | 1/1992 | Jahn | 101/218 |
| 5,088,404 | | 2/1992 | MacConnell et al. | 101/232 |
| 5,186,107 | * | 2/1993 | Wieland | 101/409 |
| 5,228,390 | | 7/1993 | Jahn | 101/352 |
| 5,649,482 | * | 7/1997 | Hummel et al. | 101/218 |
| 5,983,793 | * | 11/1999 | Volz et al. | 101/216 |

FOREIGN PATENT DOCUMENTS

| | | |
|---|---|---|
| 32 20 364 C2 | 2/1985 | (DE) . |
| 44 43 493 A1 | 6/1996 | (DE) . |
| 195 37 421 C1 | 3/1997 | (DE) . |
| 196 27 478 C2 | 4/1998 | (DE) . |
| 197 19 624 C1 | 6/1998 | (DE) . |
| 0 306 682 B1 | 12/1992 | (EP) . |

* cited by examiner

*Primary Examiner*—Daniel J. Colilla
(74) *Attorney, Agent, or Firm*—Herbert L. Lerner; Laurence A. Greenberg; Werner H. Stemer

(57) ABSTRACT

A sheet-fed rotary printing machine has a plurality of units arranged in tandem, at least one of the units including a first cylinder for transporting a sheet and a second cylinder disposed opposite the first cylinder, the first cylinder and the second cylinder being mounted so as to be disengageable from one another; the second cylinder being stoppable and having a device by which an outer portion of the second cylinder is displaceable; and a method of transporting a sheet through a unit of the printing machine.

21 Claims, 7 Drawing Sheets

SHEET-FED ROTARY PRINTING MACHINE AND METHOD OF TRANSPORTING SHEETS INCLUDING A CYLINDER WITH A DISPLACEABLE OUTER PORTION

BACKGROUND OF THE INVENTION

Field of the Invention

The invention relates to a sheet-fed rotary printing machine having a plurality of units arranged in tandem, at least one unit being an offset printing unit or a varnishing unit, which includes a first cylinder transporting the sheet and a second cylinder opposite the first cylinder, the first and the second cylinder being mounted so that they are disengageable from one another. The invention also relates to a method of transporting sheets through at least one of the units of the printing machine.

In multicolor printing machines of the foregoing type, downline of which a varnishing unit may be arranged, the paper sheets are often printed with color only in the first printing units. Following printing units or the varnishing unit run "empty" at the same time if this is required by the relevant print job, specifically if either the maximum number of colors for which the machine is equipped are not needed, or if no application of varnish is desired by the customer.

When "running empty" in this manner, the previously freshly printed sheets are conveyed through the succeeding printing unit or units, while the rubber blanket cylinder of the offset printing unit, for example, or the varnishing blanket cylinder of the varnishing unit are disengaged from the associated impression cylinder, i.e, the sheets are gripped at the leading end thereof by grippers on the respective impression cylinder and, in contact wit h the latter, are transported through the small nip which is then produced between the respective impression cylinder and the rubber blanket and varnishing blanket cylinder, respectively.

Because of the high machine speeds, however, the sheets lift off the respective impression cylinder, and the freshly printed side of the sheets touches the rubber blanket or varnishing blanket, with the result that the ink applied to the sheets becomes smeared. This can occur even at relatively low speeds if the printing material has a given stiffness. This is because heavy paper grades have a greater tendency to lift off the impression cylinder because of the centrifugal forces, as do stiff boards as well as a result of the attempt thereof to assume the stretched-out position, and become smeared on the rubber blanket cylinder in the narrow nip of about 5 mm. between the impression cylinder and the rubber blanket cylinder.

In order to avoid this problem, it has been proposed, for example in the published German Patent Document DE 43 18 777 C2, to hold down the freshly printing sheets with blown air as they pass through the printing nip. German Patents DE 689 632 and DE 44 43 493 treat in general terms the problem of flexurally stiff materials lifting off the impression cylinder, and propose the provision of cones or cylindrical rollers which act mechanically upon the edge of the sheet to be printed, so that the sheets to be printed are held down thereby. However, such cones or cylindrical rollers cannot readily be arranged at the critical location, namely the narrow nip between the impression cylinder and the rubber blanket or varnishing blanket cylinder, the nip, after the rubber blanket or varnishing blanket has been disengaged or brought out of contact and removed, being about 5 mm. wide.

SUMMARY OF THE INVENTION

Based upon the foregoing prior art, it is accordingly an object of the invention to provide a sheet-fed rotary printing machine which permits a smear-free sheet run through printing and varnishing units, respectively, thereof, which have been disengaged or brought out of contact, and a method of transporting sheets to accomplish this objective.

With the foregoing and other objects in view, there is provided, in accordance with one aspect of the invention of the instant application, a sheet-fed rotary printing machine having a plurality of units arranged in tandem, at least one of the units comprising a first cylinder for transporting a sheet, and a second cylinder disposed opposite the first cylinder, the first cylinder and the second cylinder being mounted so as to be disengageable from one another; the second cylinder being stoppable and having a device by which an outer portion of the second cylinder is displaceable.

In accordance with another feature of the invention, the at least one unit is selected from the group thereof consisting of a printing unit and a varnishing unit.

In accordance with a further feature of the invention, the first cylinder for transporting the sheet is an impression cylinder, and the second cylinder is a cylinder selected from the group thereof consisting of a rubber blanket cylinder and a varnishing blanket cylinder of an offset printing unit and a varnishing unit, respectively.

In accordance with an added feature of the invention, the second cylinder is uncouplable by a clutch from a drive of one of the printing and the varnishing units, respectively.

In accordance with an additional feature of the invention, the second cylinder is stoppable in a position wherein the displaceable outer portion thereof is disposed opposite the first cylinder.

In accordance with yet another feature of the invention, the displaceable portion of the second cylinder has a clamping device for a covering of the second cylinder.

In accordance with yet a further feature of the invention, the displaceable portion of the second cylinder forms part of the circular outer surface of the second cylinder.

In accordance with yet an added feature of the invention, the displaceable portion of the second cylinder is removably fastened to the latter.

In accordance with yet an additional feature of the invention, the outer portion of the second cylinder is displaceable into the interior of the second cylinder.

In accordance with still another feature of the invention, the displaceable portion of the second cylinder is mounted so as to be pivotable about an axis aligned parallel to an axis of rotation of the second cylinder.

In accordance with still a further feature of the invention, the displaceable portion of the second cylinder is provided with an outwardly pivotable sheet guide element.

In accordance with still a further feature of the invention, the sheet guide element is formed with a surface which, when in an outwardly displaced position, extends concentrically with the surface of the first cylinder.

In accordance with still an added feature of the invention, the portion of the second cylinder is displaceable linearly in a direction towards the interior of the second cylinder.

In accordance with another aspect of the invention, there is provided a method of transporting a sheet through a disengageable unit selected from the group consisting of printing and varnishing units in a sheet-fed rotary printing machine, which comprises providing a first cylinder for transporting a sheet, and a second cylinder located opposite the first cylinder; stopping the second cylinder in a position wherein a movable, outer portion of the second cylinder is disposed opposite the first cylinder; and removing the movable, outer portion of the second cylinder or displacing it in a direction towards the interior of the second cylinder.

In accordance with another mode of the method according to the invention, wherein the second cylinder is one of a rubber blanket and a varnishing blanket cylinder of an offset printing unit and a varnishing unit, respectively, having a blanket clamping device, the method includes removing the blanket clamping device or displacing the blanket clamping device into the interior of the second cylinder.

In accordance with a further mode of the method according to the invention, wherein the second cylinder has a convex outer surface having one segment, the method includes removing the one segment of the convex outer surface of the second cylinder or displacing the one segment inwardly.

In accordance with a concomitant mode, the method of the invention includes initially removing the blanket selected from the group consisting of a rubber blanket and a varnishing blanket, respectively, from the second cylinder; then positioning the second cylinder so that the movable, outer portion of the second cylinder is located opposite a cylinder gap formed in the first cylinder; and finally pivoting the movable, outer portion about an axis parallel to the axis of rotation of the second cylinder.

The invention is based upon the knowledge that it is markedly simpler to avoid smearing if the nip between the first cylinder, i.e., the impression cylinder, and the second cylinder, i.e., the rubber blanket or varnishing blanket cylinder, for example, that is associated therewith, is enlarged or widened beyond the extent that is predefined when the cylinders are disengaged or brought out of contact. This is preferably performed by stopping the second cylinder, i.e., the rubber blanket or varnishing blanket cylinder, and, if necessary, after removing the rubber blanket or varnishing blanket, displacing a segment or portion of the cylinder. This displacement may be performed by removing the relevant portion and the relevant segment of the cylinder, respectively, i.e., disassembled or simply displaced into the interior of the cylinder, which is particularly expedient. This can be effected by appropriately rotating the aforementioned segment and portion of the cylinder, respectively, or by a linear movement which displaces the segment away from the impression cylinder into the interior of the rubber blanket and varnishing blanket cylinder, respectively. During subsequent printing, this further rubber blanket and varnishing blanket cylinder, respectively, remains uncoupled from the drive of the printing machine, for example, by a clutch, in a position wherein the removed or displaced segment is located opposite the impression cylinder. In this way, the distance between the impression cylinder, on the one hand, and the rubber blanket and varnishing blanket cylinder, respectively, on the other hand, can be enlarged or widened to such an extent that the risk of smearing is reduced considerably or is largely avoided, depending upon the printing speed and the stiffness of the printing material.

It is advantageous if, for this purpose, the clamping device or devices needed for clamping the rubber and varnishing blanket, respectively, in the cylinder gap of the relevant cylinder are displaced, these installed cylinder-gap fittings either being removed or, what is particularly expedient, being pivoted into the interior of the cylinder about an axis parallel to the cylinder axis. This is because the latter measure can be performed rapidly and simply, when provided with a suitable design, and, if necessary, can also be automated.

Other features which are considered as characteristic for the invention are set forth in the appended claims.

Although the invention is illustrated and described herein as embodied in a sheet-fed rotary printing machine and a method of transporting sheets through a unit thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings; wherein:

DESCRIPTION OF THE PREFERRED EMBODIMENTS

Figure 1:
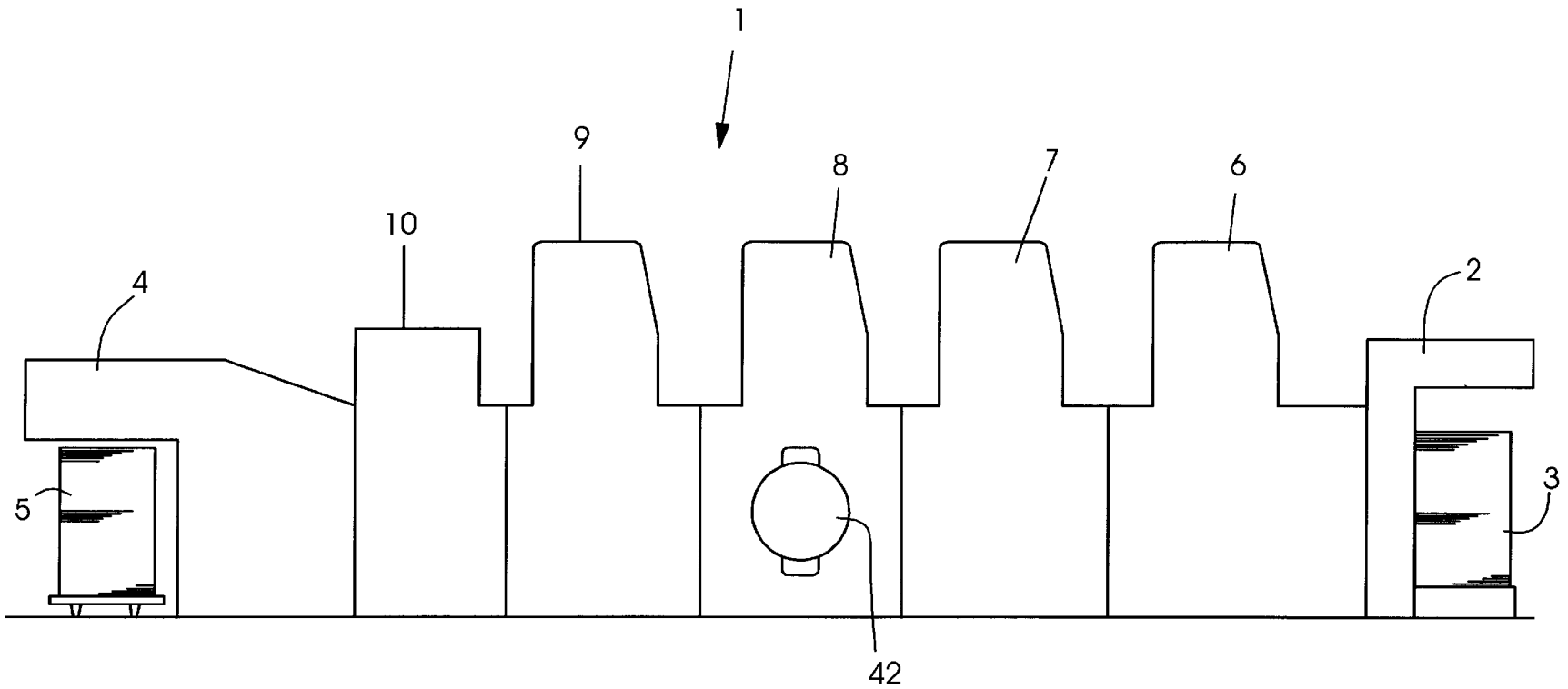
FIG. 1 is a diagrammatic side elevational view of a printing machine of unit construction having a plurality of printing units and a varnishing unit.

Referring now to the drawings and, first, particularly to FIG. 1 thereof, there is shown therein, in diagrammatic form, a sheet-fed offset printing machine 1 of unit or in-line construction. It has a feeder 2, which is used to transport paper sheets from a pile 3 into a first printing unit 6. There, and in three succeeding printing units 7, 8 and 9, the conveyed paper sheets are printed after one another with four colors and then pass into a varnishing unit 10, where a varnish layer is applied over the entire surface of the sheets before they are deposited by a delivery 4 on a delivery pile 5 after passing through non-illustrated drying and powdering units.

The cylinders which transport the sheet in the printing units 6 to 9 and in the varnishing unit 10 are connected to one another by a non-illustrated spur gear mechanism, and are driven jointly by a main drive motor 42.

Figure 2:
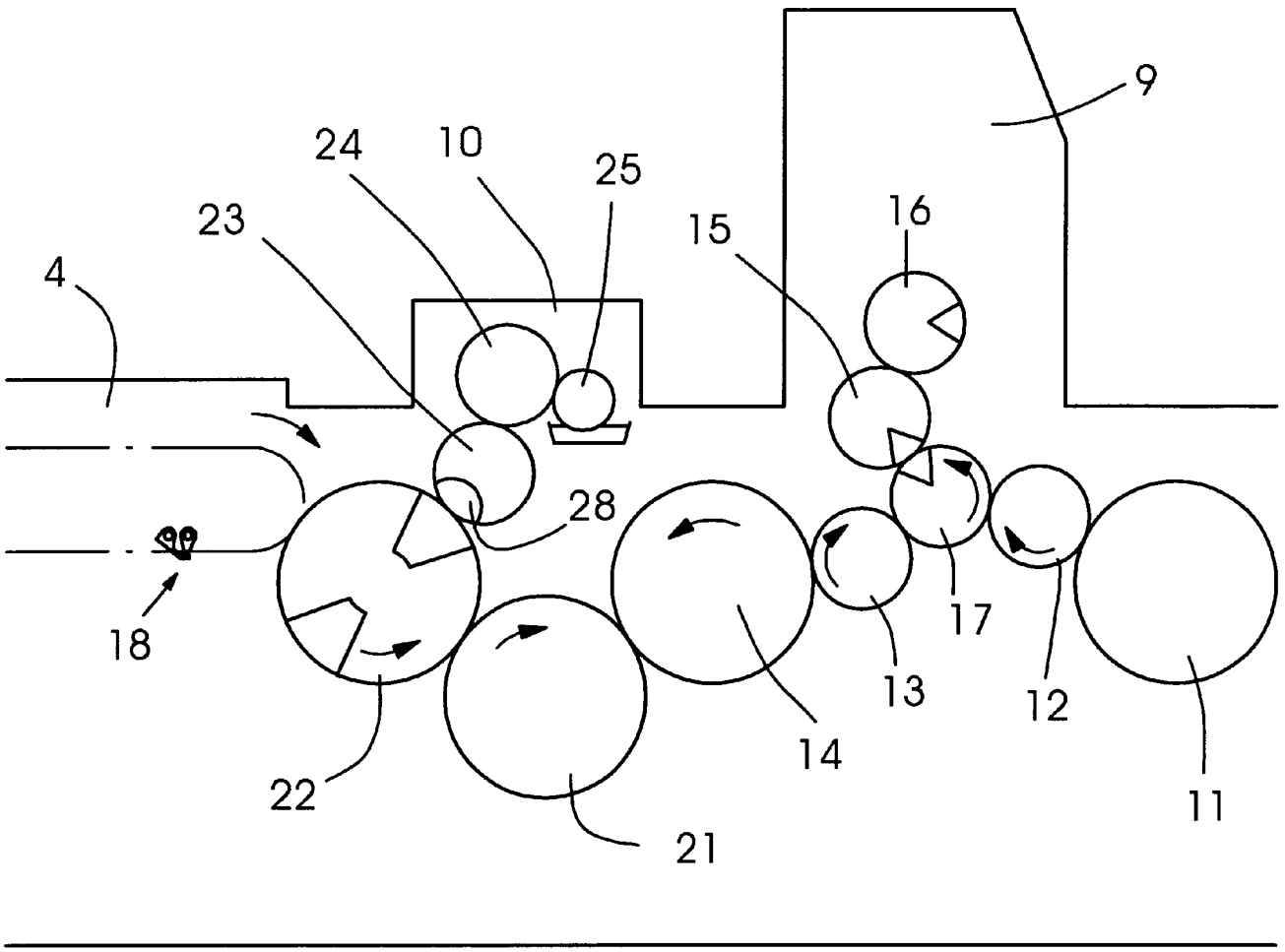
FIG. 2 is an enlarged fragmentary view of FIG. 1 showing the units 9 and 10 of the printing machine with cylinders used for paper transport and for printing, respectively.

As can be seen from the somewhat detailed view according to FIG. 2, the printing unit 9 is an offset printing unit having a plate cylinder 16 and a rubber blanket cylinder 15, by which a sheet transported by transfer drums 11 and 12 and fed to an impression cylinder 17 is then printed with ink. The inking unit, which is used to ink the printing plate on the plate cylinder 16, is not illustrated in FIG. 2. The impression cylinder 17 in the printing unit 9 is followed by three further transfer cylinders 13, 14 and 21, which transport the sheet onward and transfer it to the impression cylinder 22 in the varnishing unit 10. There, the sheet is varnished over the entire surface thereof by a varnishing blanket that is clamped onto the varnishing blanket cylinder 23, and is then transferred to a gripper bar 18 on transport chains of the delivery 4. The application of varnish to the varnishing blanket clamped onto the cylinder 23 is performed by two rollers 24 and 25, the roller 24 being an applicator roller and the roller 25 being a dip roller running in a varnish trough. The width of the gap or nip between the two rollers 24 and 25 effects the metering of the quantity of varnish.

Figure 3A:
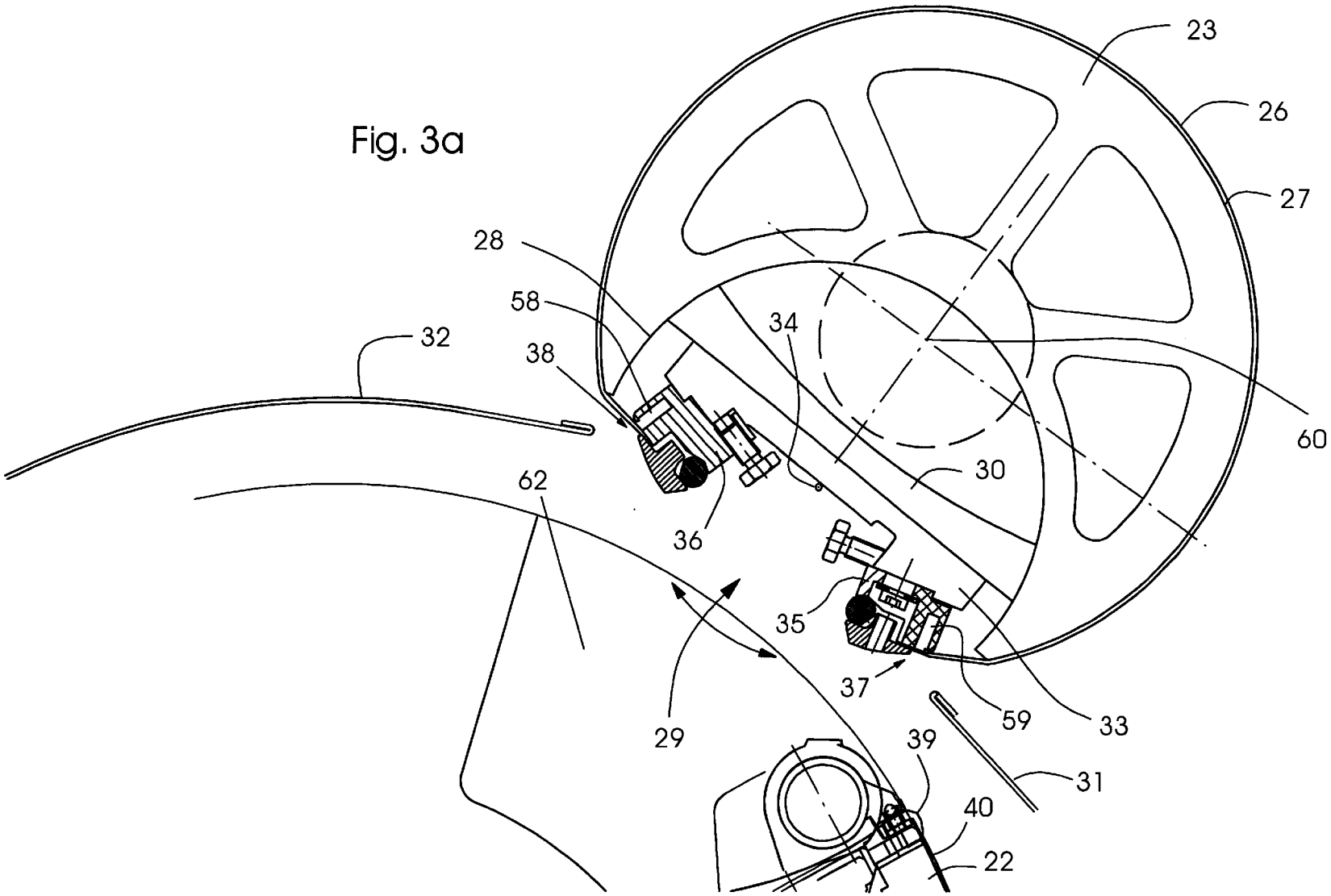
FIG. 3*a* is an enlarged fragmentary view of FIG. 2 showing in greater detail a first exemplary embodiment of a varnishing blanket cylinder of the varnishing unit of the printing machine, the varnishing blanket cylinder being engaged with an impression cylinder of the printing machine.

FIG. 3*a* illustrates the varnishing blanket cylinder 23 of the varnishing unit 10 in section and on an enlarged scale, specifically in a form wherein it is suitable for applying varnish to the sheet 40. The cylinder 23 has a ribbed metal casting formed with a cylindrical outer surface that is interrupted at the location 28 by a so-called cylinder or lock-up gap. In the exemplary embodiment shown, the cylinder gap 28, for reasons which will be explained further hereinbelow, also has the approximate shape of a cylinder, but with a smaller diameter than that of the outer surface of the cylinder 23. This need not be so, however; the significant factor alone is that the cylinder gap 28 provides sufficient space for the installed fittings to pivot. In this portion of the varnishing blanket cylinder 23 formed by the cylinder gap 28, two clamping rails 35 and 36 are fastened on a support 33 mounted thereat. On the clamping rails 35 and 36, the ends of the varnishing blanket 25 are either gripped by clamping bars 37 and 38, as illustrated in FIG. 3*a*, or are hooked into grooves 58 and 59 formed in the clamping rails 36 and 37, respectively, depending upon the type of varnishing blanket that is used.

Figure 3B:
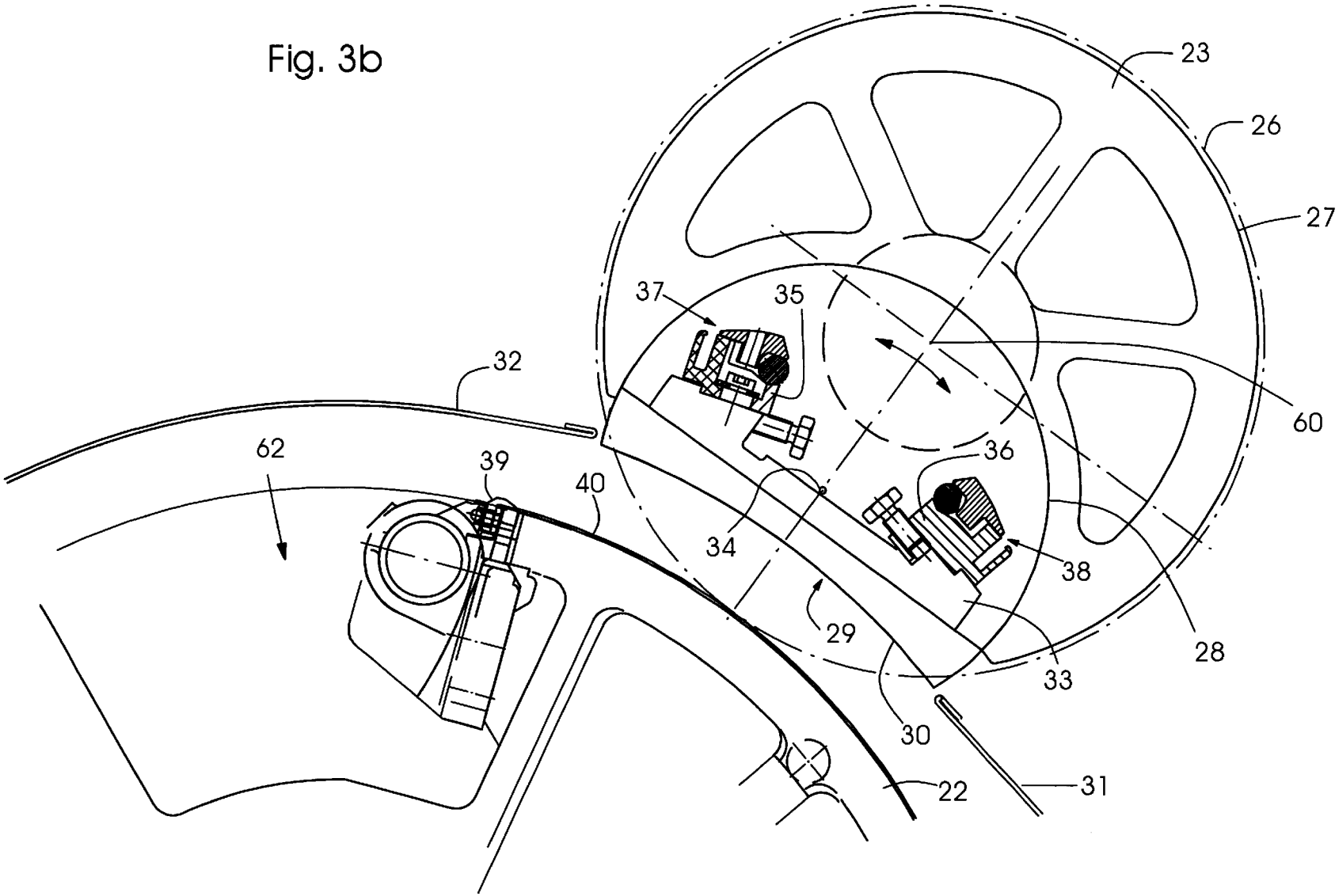
FIG. 3*b* is a view like that of FIG. 3*a* but with the varnishing blanket cylinder disengaged from or having been brought out of contact with the impression cylinder, the varnishing blanket having been removed from the varnishing blanket cylinder, and fittings installed in the cylinder gap having been pivoted out of the position thereof shown in FIG. 3*a;*
Figure 6:
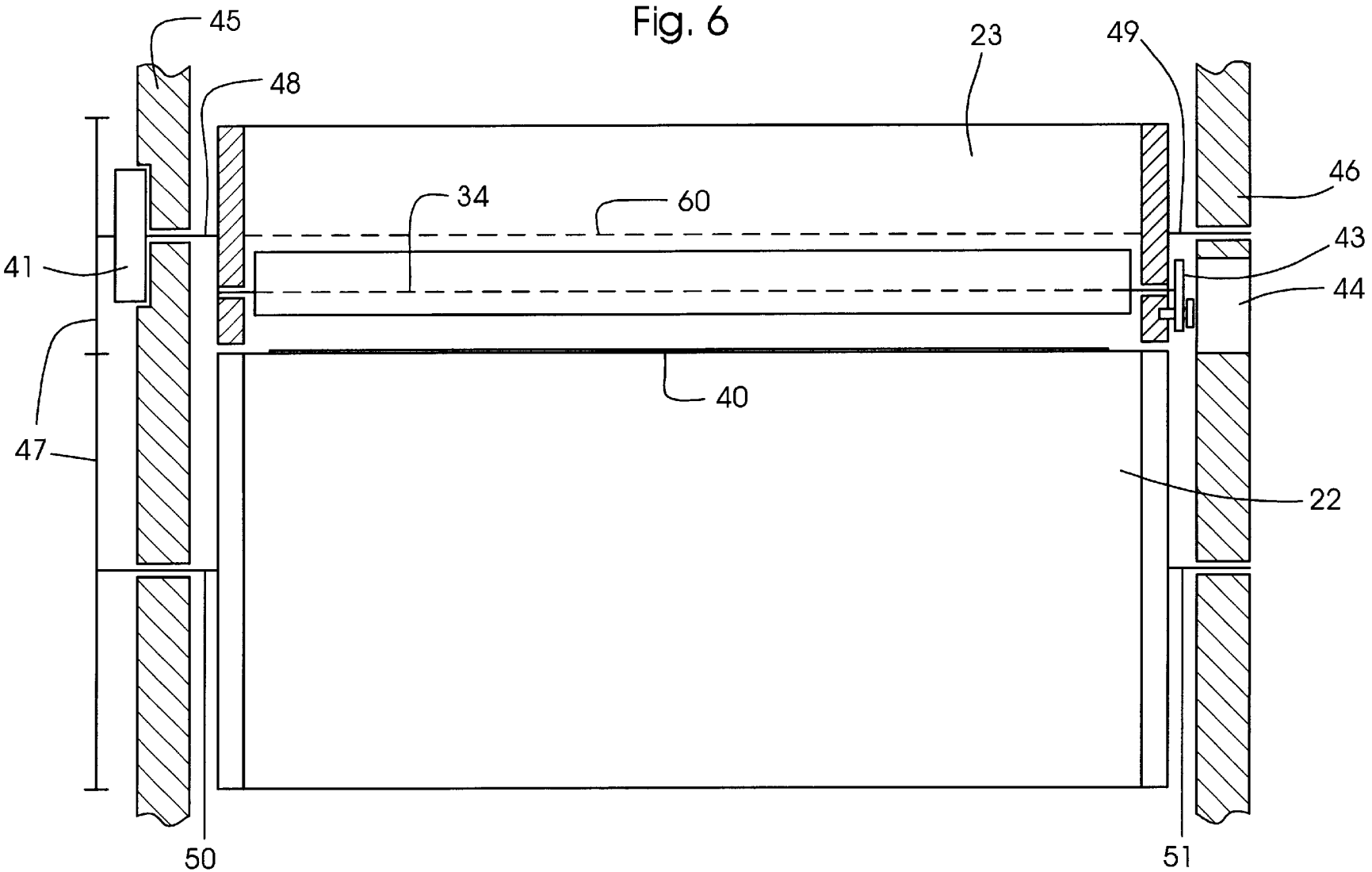
FIG. 6 is an enlarged, very highly diagrammatic longitudinal sectional view of the varnishing unit of FIG. 2 in the region of the printing nip between the varnishing blanket cylinder and the impression cylinder.

A support 33 is mounted by appropriate axle journals in the two ends of the cylinder 23 so as to be pivotable about an axis 34. The purpose therefor is as follows:

If the sheet 40, which is held on the impression cylinder 22 by a gripper 39, 139, 239 and has been printed with four colors in the units 6 to 9, is not to be varnished over the entire surface thereof, as sketched in FIG. 3*a*, it is conveyed through the nip between the impression cylinder 22 and the varnishing blanket cylinder 23, with the varnishing unit 10 disengaged or brought out of contact, as will be explained hereinbelow with reference to FIG. 3*b*. In order to enlarge this nip as far as possible, when the main drive 42 (note FIG. 1) of the printing machine 1 is stopped in a position wherein the cylinder gap 28 of the varnishing blanket cylinder 23 is located opposite the cylinder gap 62, 162, 262 of the impression cylinder 22 (FIG. 3*a*), the installed gap fittings 29, together with the support 33, are pivoted about the axis 34, after the cylinder 23 has previously been disengaged or brought out of contact with the cylinder 22, and the varnishing blanket 26 has been removed. The drive to the cylinder 23 is then disengaged from the drive train 47 (note FIG. 6) of the printing machine 1 via a clutch 41. The cylinder 23 then remains stationary in the position illustrated in FIG. 3*b*. In this case, a sheet guide element 30 fastened to the underside of the support 33 for the clamping rails 35 and 36 forms a bridge between two permanently installed sheet guide plates 32 and 31, which are arranged concentrically with the surface of the impression cylinder 22.

The radius of the sheet guide element 30 is somewhat longer than the radius of the cylinder 22 and is located approximately concentrically opposite the latter. In the position drawn, wherein it is rotated through about 180°, the support 33 is locked by a device 43 shown in FIG. 6. The locking can be performed manually by operating personnel, as can the rotation of the installed cylinder fittings, through an opening 44 (FIG. 6) in a side wall 46 of the printing machine 1, or if suitable actuators are provided, it can also be performed automatically, controlled by the printing machine. In the position shown in FIG. 3*b*, there is significantly more space between the sheet 40 on the impression cylinder 22 and the concentric surface of the sheet guide element 30, than if the cylinder 23 had simply been disengaged or brought out of contact with the cylinder 22 as was previously usual, i.e., had simply been displaced by a total of about 2 mm, and the varnishing blanket had been removed. Because virtually a continuous, smooth matching surface results at a distance of a few centimeters from the sheet 40, in addition due to the sheet guide element 30 being provided instead of the installed channel fittings, in conjunction with the guide plates 31 and 32, the risk of smearing of the freshly printed surface of the sheet 40 is virtually ruled out, even in the case of relatively stiff sheets such as cardboard or pasteboard, for example, which tends to lift off the impression cylinder 22. This is because the continuous surface formed by the sheet guide plates and the sheet guide element then guides the lifted trailing edge of the sheet at the unprinted edge region thereof, so that it has no possibility of striking the printed locations anywhere.

In the afordescribed exemplary embodiment, the support 33 is rotated or pivoted with the installed channel fittings 29. Instead of displacing the installed channel fittings 29 into the interior of the cylinder 23 by pivoting, as described, it is also possible, however, as an alternative thereto, to remove the installed channel fittings 29 completely, for example by disassembling the support 33 from the cylinder gap 28 and replacing it by an appropriately shaped sheet guide element 30.

Figure 4:
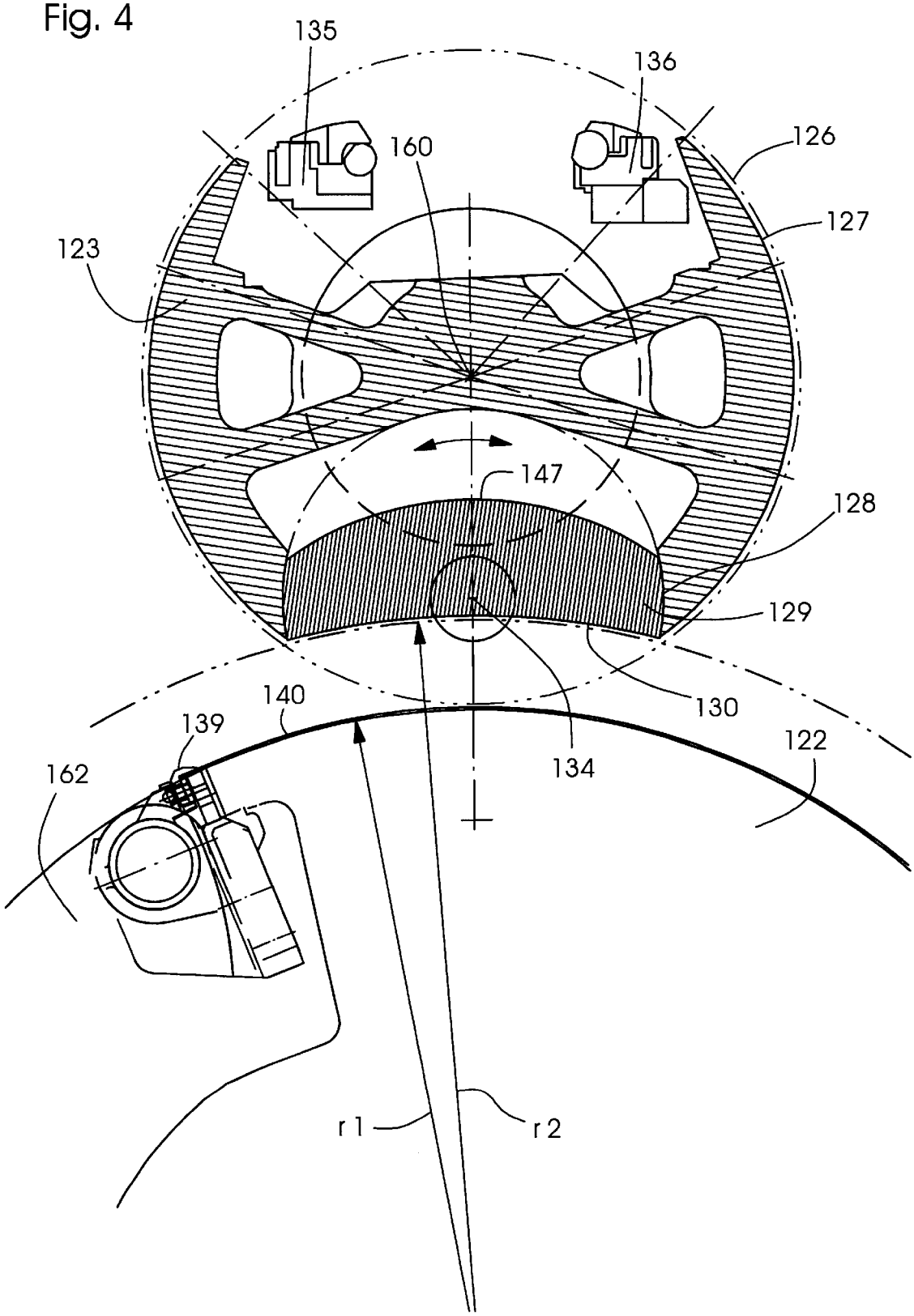
FIG. 4 is an enlarged fragmentary of FIG. 2 showing in cross section a second exemplary embodiment of the varnishing blanket cylinder of the varnishing unit.

A further alternative exemplary embodiment is illustrated in FIG. 4. Here, the installed cylinder fittings remain in the position which is usual for clamping the varnishing blanket 26, 126, 226 and are permanently mounted thereat in the cylinder gap, respectively. Instead, a segment 129 of the cylinder cover of the varnishing blanket cylinder 123 is disposed so that it can pivot about an axis 134 in a manner similar to that of the support plate 33 in FIGS. 3*a* and 3*b*, the axis 134 extending parallel to the axis 60, 160, 260 of the cylinder 123 and being arranged between the cylinder outer surface 127 and the extension thereof, respectively, and the axis of rotation 60, 160, 260 of the cylinder 123. After the segment 129 has been pivoted through 180°, the normally outer convex cylinder surface 147, 247 of the segment 129 is displaced inwardly into a cavity 128 formed in the cylinder 123 and, instead, a concave sheet guide surface 130 assumes its place on the other side of the segment 129. The sheet guide surface 130 is likewise again aligned with the radius r2 thereof concentric with the radius r1 of the surface of the impression cylinder 122, 222, and the rather great distance between the surfaces of the impression cylinder and the varnishing blanket cylinder, achievable by the difference between the respective radii r1 and r2, ensures that the sheet 140 transported without any application of varnish passes through the varnishing unit. Otherwise, like parts shown in FIG. 4 are identified by the same reference numeral as in FIG. 3 increased by 100, and will not be explained or described again at this juncture. It is believed to be quite clear that the individual steps up to the positioning of the cylinder 123 in the position shown in FIG. 4 are like those relating to the positioning of the cylinder 23 in FIG. 3.

Figure 5:
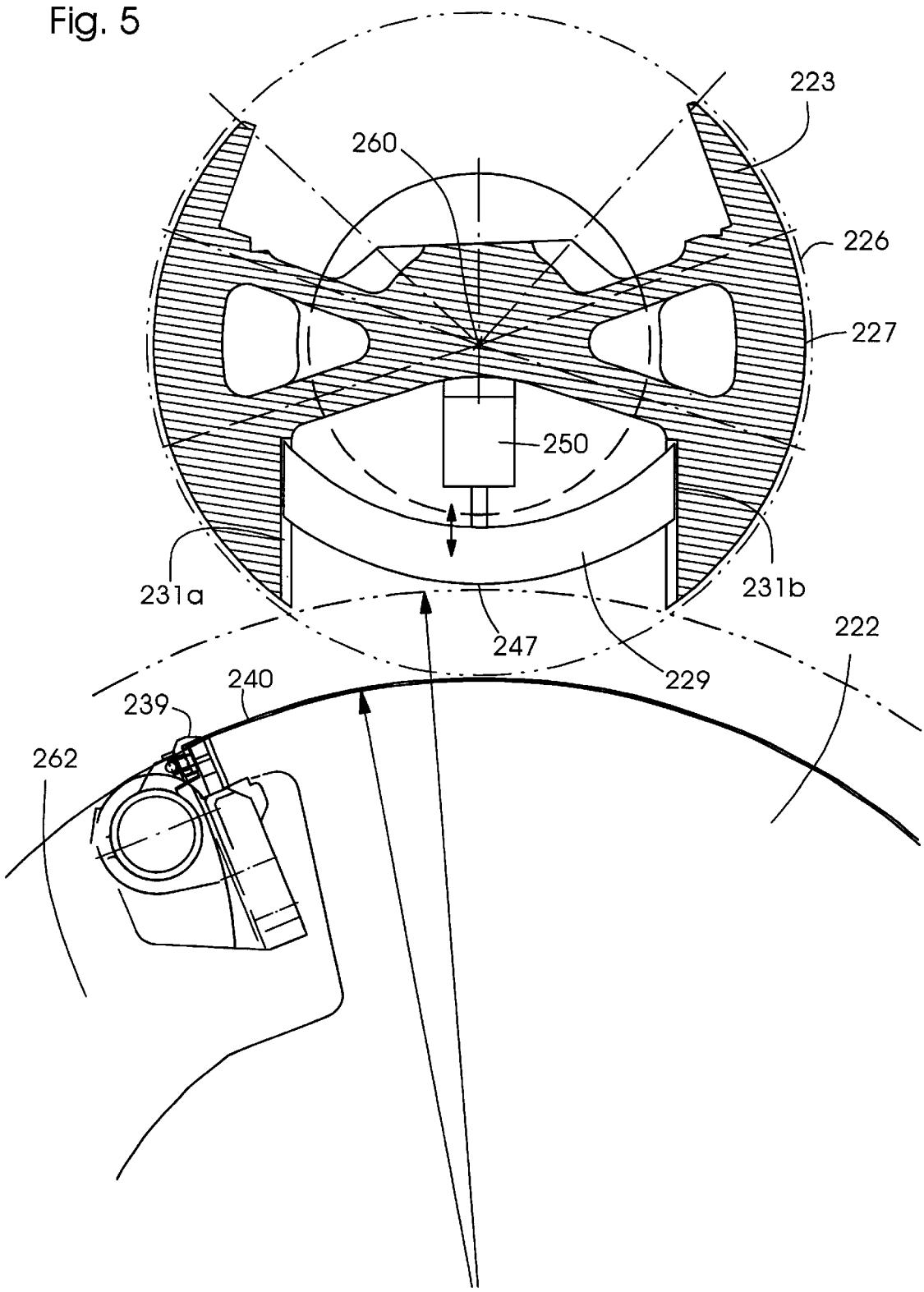
FIG. 5 is a view like that of FIG. 4 of a third exemplary embodiment of the varnishing blanket cylinder of the vanishing unit.

In addition, the segment 129 can also be displaced in any other way in order to create space between sheet and varnishing blanket cylinder, specifically as illustrated in FIG. 5, for example. Herein, the segment 229 of the cylinder outer surface 227 of the varnishing blanket cylinder 223 is withdrawn or retracted several centimeters into the interior of the cylinder 223 with the aid of linear guides 231*a* and 231*b*, specifically using an actuator 250, for example, in the form of a geared motor, which is driven from the operating console of the printing machine 1 in response to an appropriate command. This applies as well to the support plate 33 in the exemplary embodiment according to FIG. 3, i.e., in that it too can be rotated through 180° by a motor.

In the foregoing exemplary embodiments, the invention has been illustrated with reference to the varnishing unit 10 of the printing machine 1 according to FIG. 1. In a like manner, however, when one of the printing units 7, 8 or 9 is stopped, it is also possible to have the sheet, for example, printed in the printing unit 6 pass through without smearing, by carrying out the measures described for the varnishing blanket cylinder 23 instead or additionally also for the rubber blanket cylinder 15 in the relevant printing units as well.

We claim:

1. A sheet-fed rotary printing machine having a plurality of units arranged in tandem, at least one of the units comprising:

a first cylinder for transporting a sheet and a second cylinder disposed opposite said first cylinder, said second cylinder being mounted so as to be disengageable from said first cylinder, said second cylinder having a device by which an outer portion of said second cylinder is displaceable;

a clutch for selectively coupling said second cylinder to a drive for driving said first cylinder.

2. The sheet-fed rotary printing machine according to claim 1, wherein the at least one unit is selected from the group thereof consisting of a printing unit and a varnishing unit.

3. The sheet-fed rotary printing machine according to claim 1, said first cylinder for transporting the sheet is an impression cylinder, and said second cylinder is a cylinder selected from the group thereof consisting of a rubber blanket cylinder and a varnishing blanket cylinder of an offset printing unit and a varnishing unit, respectively.

4. The sheet-fed rotary printing machine according to claim 1, wherein said displaceable portion of said second cylinder has a clamping device for a covering of said second cylinder.

5. The sheet-fed rotary printing machine according to claim 4, which comprises linear guides for displacing said portion of said second cylinder linearly in a direction towards an interior of said second cylinder.

6. The sheet-fed rotary printing machine according to claim 1, wherein said displaceable portion of said second cylinder forms part of the circular outer surface of said second cylinder.

7. The sheet-fed rotary printing machine according to claim 1, wherein said displaceable portion of said second cylinder is removably fastened to the latter.

8. The sheet-fed rotary printing machine according to claim 1, which comprises linear guides for displacing said portion of said second cylinder into an interior of said second cylinder.

9. The sheet-fed rotary printing machine according to claim 1, wherein said displaceable portion of said second cylinder is provided with an outwardly pivotable sheet guide element.

10. The sheet-fed rotary printing machine according to claim 9, wherein said sheet guide element is formed with a surface which, when in an outwardly displaced position, extends concentrically with the surface of said first cylinder.

11. The sheet-fed rotary printing machine according to claim 1, which comprises linear guides for displacing said portion of said second cylinder linearly in a direction towards an interior of said second cylinder.

12. A method of transporting a sheet through a disengageable unit selected from the group consisting of printing and varnishing units in a sheet-fed rotary printing machine, which comprises providing a first cylinder for transporting a sheet, and a second cylinder located opposite the first cylinder, stopping the second cylinder in a position wherein a movable, outer portion of the second cylinder is disposed opposite the first cylinder, and removing the movable, outer portion of the second cylinder.

13. The method according to claim 12, wherein the second cylinder is one of a rubber blanket of an offset printing unit and a varnishing blanket cylinder of a varnishing unit, having a blanket clamping device, and which includes removing the blanket clamping device or displacing the blanket clamping device into the interior of the second cylinder.

14. The method according to claim 13, which includes initially removing the blanket selected from the group consisting of a rubber blanket and a varnishing blanket, respectively, from the second cylinder; then positioning the second cylinder so that the movable, outer portion of the second cylinder is located opposite a cylinder gap formed in the first cylinder; and finally pivoting the movable, outer portion about an axis parallel to the axis of rotation of the second cylinder.

15. The method according to claim 12, wherein the second cylinder has a convex outer surface having one segment and which includes removing the one segment of the convex outer surface of the second cylinder.

16. The method according to claim 12, wherein the second cylinder has a convex outer surface having one segment and which includes displacing the one segment inwardly.

17. A method of transporting a sheet through a disengageable unit selected from the group consisting of printing and varnishing units in a sheet-fed rotary printing machine, which comprises providing a first cylinder for transporting a sheet, and a second cylinder located opposite the first cylinder, stopping the second cylinder in a position wherein a movable, outer portion of the second cylinder is disposed opposite the first cylinder, and displacing the outer portion of the second cylinder in a direction towards the interior of the second cylinder.

18. The method according to claim 17, wherein the second cylinder is one of a rubber blanket of an offset printing unit and a varnishing blanket cylinder of a varnishing unit, having a blanket clamping device, and which includes removing the blanket clamping device or displacing the blanket clamping device into the interior of the second cylinder.

19. The method according to claim 18, which includes initially removing a blanket selected from the group consisting of a rubber blanket and a varnishing blanket, respectively, from the second cylinder; then positioning the second cylinder so that the movable, outer portion of the second cylinder is located opposite a cylinder gap formed in the first cylinder; and finally pivoting the movable, outer portion about an axis parallel to the axis of rotation of the second cylinder.

20. The method according to claim 17, wherein the second cylinder has a convex outer surface having one segment and which includes removing the one segment of the convex outer surface of the second cylinder.

21. The method according to claim 17, wherein the second cylinder has a convex outer surface having one segment and which includes displacing the one segment inwardly.

* * * * *